US010081411B1

(12) United States Patent
Bello et al.

(10) Patent No.: US 10,081,411 B1
(45) Date of Patent: Sep. 25, 2018

(54) SIGNALING APPARATUS AND SYSTEM TO IDENTIFY AND LOCATE MARINE OBJECTS AND HAZARDS

(71) Applicant: MIKELLO VENTURES, LLC, Miami, FL (US)

(72) Inventors: Anthony D Bello, Miami, FL (US); Gregory P Mikusinski, Miami, FL (US)

( * ) Notice: Subject to any disclaimer, the term of this patent is extended or adjusted under 35 U.S.C. 154(b) by 0 days.

(21) Appl. No.: 15/799,667

(22) Filed: Oct. 31, 2017

(51) Int. Cl.
*G05B 23/00* (2006.01)
*B63B 22/16* (2006.01)
*B63B 49/00* (2006.01)

(52) U.S. Cl.
CPC ..... *B63B 22/163* (2013.01); *B63B 22/166* (2013.01); *B63B 49/00* (2013.01)

(58) Field of Classification Search
CPC ..... G01S 1/00; G08B 1/00
See application file for complete search history.

(56) References Cited

U.S. PATENT DOCUMENTS 3,772,692 A * 11/1973 Braddon ..... G01S 13/78 342/190
2001/0044282 A1* 11/2001 Lanza ..... H04B 1/46 455/92
2016/0266246 A1* 9/2016 Hjelmstad ..... G01S 17/023

* cited by examiner

*Primary Examiner* — Shirley Lu
(74) *Attorney, Agent, or Firm* — Sanchelima & Associates, P.A.; Christian Sanchelima; Jesus Sanchelima

(57) ABSTRACT

The present disclosure discloses a system wherein coin-sized beacons can be attached to marine and other hazards such as buoys, shipwrecks, jetties and the like. The beacons can also be configured to a user's life jacket or other intimate item worn by divers or passengers. The beacon is equipped with an ability to emit sound/radio or light (Bluetooth or otherwise) waves that are detected by a user's receiving device hardware located aboard a vessel to alert the user of an approaching hazard. The signal can be configured to provide the location or distance and proximity to the vessel of the beacon and contact information of the beacon's registered owner. The beacon can continuously transmit these signals to alert oncoming vessels of the location of the beacon, or aid in the recovery of an overboard passenger or keep track of underwater divers. Further, the receiving device hardware can be adapted to a vessel's navigation system to automatically avoid marine hazards using the vessel's autopilot system.

13 Claims, 5 Drawing Sheets

SIGNALING APPARATUS AND SYSTEM TO IDENTIFY AND LOCATE MARINE OBJECTS AND HAZARDS

OTHER RELATED APPLICATIONS

The present application does not claim priority from any other application.

BACKGROUND OF THE INVENTION

Field of the Invention

The present invention relates to position indicating devices and, more particularly, to beacons used to indicate position of objects that a user wants to avoid such as navigational hazards including but not limited to buoys, navigation markers, sunken ships, and jetties. Also, the beacons emitting from the objects can be used to find and retrieve the objects including but not limited to fishermen traps and passengers that have fallen overboard.

Description of the Related Art

Typically, people use transport systems via land, or water to move from one place to another. On land, people get from one place to another by using maps, street signs, detours, and traffic lights. On the water, people, such as captains, fishermen or mariners navigate by using nautical charts and GPS incorporated into software and hardware. Further, the mariners navigate through the water by paying attention to Aids to Navigation (ATON)-lights, buoys, daymarks, and fog signals provided in the water at appropriate positions. As known, a nautical chart is a map that shows what is under, in, on, or around the water. Buoys are floating aids that are anchored to the seabed and/or attached to portable objects laying on the seabed. Typically, the buoys are provided in different shapes, colors and may use different sound signals and lights. Based on the shape and color of the buoys, the mariners identify the buoy by cross referencing them with the indicators on a nautical chart. The buoys themselves can pose navigational hazards. In addition, other objects in the water can serve as navigational hazards, such as traps set by fishermen to catch lobster and/or crabs, which include a rope connecting it to a buoyant buoy used to identify the location of the trap and the trap itself. These buoys and ropes can become tangled with the propeller of passing vessels that go over the traps.

Sound signals are also used to guide vessels and ships when there is low visibility, such as fog. Similar to shape and color of the buoys, different sound signals are generated to indicate a situation or to alert the vessels of the presence of the buoys or any other structure. Extreme weather may pose several problems to the mariners or may cause the buoys or traps to shift from location to location. For example, if the visibility is poor due to bad weather, then the buoys or trap markers may not be visible to the mariners. Similarly, the mariners may not hear the sound signals produced from the buoys during extreme weather conditions such as heavy rain or cyclone. Without proper indications, the mariners may crash into the navigational hazards.

Several methods for aiding the mariners to navigate through the water have been proposed in the past. None of them, however, include attaching beacons to the navigational hazards which will aid the mariners to navigate through the waters without any difficulty.

Applicant believes that a related reference corresponds to a Chinese patent No. 201766712 issued to Chen Hua and Chen Jiao. However, the reference differs from the present invention because CN201766712 discloses a method of installing a camera on the buoy. The camera captures the surroundings and transmits the visual to the server. The server in turns shares the visuals with the nearby ships carrying mobile phones. The mariners in the ships can use the visuals obtained by the camera and navigate past the buoy. It must be noted that capturing the visual by installing the camera may not be feasible as the visuals may not be clear during extreme weather conditions. Further, if the camera fails to transmit the visuals, the incoming mariners may not become aware of the buoys in their way and may collide with the buoys. Also, the visuals do not necessarily alert the mariners of the proximity of the navigational hazards nor does it help a fisherman locate traps that have been set. In addition, the beacon subject of the present invention can be programmed with owner identifying information so that authorities can trace back fisherman traps, for instance, to their owners. This is not taught by the Chen reference.

Another related reference corresponds to a U.S. Pat. No. 5,191,341 issued to Federation Francaise De Voile and Compagnie Generale De Geophysique. However, the reference differs from the present invention because U.S. Pat. No. 5,191,341 discloses a sea navigation control system that monitors ships, moving bodies in sea and triggers alarm in real time. The sea navigation control system continuously monitors the ships or moving objects in order to control movement of the ships without colliding with one another. The sea navigation control system calculates distance from each ship or moving body to a central station and a reference point and guides the ships to navigate without colliding without other ships. It should be noted that the arrangement as disclosed in the reference is very cumbersome and expensive. Further, it is difficult to calculate distance between each and every ship and moving body, and update respective ship to navigate past the obstruction. Further, it is difficult to update the ships about the presence of buoys that are far away from the sea navigation control system if the buoys are not considered or updated as the reference point. Any difficultly in communicating with the ship about the obstruction or the buoys may lead to collision. The main disadvantage of the De Voile reference is that it fails to address the unaddressed need of being able to easily affix a beacon to any navigational hazard and broadcast it's location as accurately as the present invention in addition to contact information for the owner of a particular buoy or fishing trap marker. Also, the present invention can be adapted to the life jackets of passengers so they can be located if they fall overboard.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a system to allow a mariner to avoid navigational hazards such as those on the water and those on land using alerts triggered by receiving Bluetooth signals and/or similar radio or light waves, including infrared, to provide the location and other information associated with a particular beacon.

It is another object of this invention to include programmable beacons that broadcast their location more accurately than GPS, and with preprogrammed information relating to a given beacon.

It is another object of the present invention to teach of a beacon that can affixed to the life jackets of passengers allowing for their quick discovery and retrieval in the event they fall overboard.

It is yet another object of the present invention to teach of a system that can be adapted to work with marine Auto-Pilot features to allow a vessel to autonomously avoid navigational hazards and other vessels with extreme precision.

It is another object of the present invention to design a beacon small enough to ergonomically and viably be mounted to virtually any size buoy, marker, hazard, fisherman trap, passenger, SCUBA diver, etc.

It is yet another object of the present invention to implement the receiver receiving the Bluetooth, light or sound signal from the beacon within a vessel's current navigational system or on a separate receiving device, potentially including a user's phone through a downloadable application.

It is another object of the present invention to develop a beacon that can either constantly or intermittently emit a Bluetooth, light or sound signal to be picked up by a receiver on the vessel of a passing user.

It is yet another object of the present invention to mount the beacons to land structures, whether natural or man-made, to warn mariners of their proximity and avoid collision.

It is yet another object of the present invention to provide a beacon programmed with encrypted contact information pertaining to the owner of a particular fisherman trap not available to mariners, but able to be decrypted by authorities such as the police, Coast Guard, Fish and Wildlife patrol, park rangers, etc.

It is another object of the present invention to provide a beacon that can be turned on selectively by a beacon's owner or administrator or be constantly on and can be powered through solar power.

It is another object of the present invention to develop a beacon that emits a Bluetooth signal or similar signal without requiring a "handshake" with a receiving device thus reducing the lag time associated with the broadcasting of location and information.

It is yet another object of this invention to provide a beacon detection system that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses beacons attached to hazards and/or other objects or individuals. The beacons are used to alert oncoming vessels of their location. Specifically, the beacons are equipped with Bluetooth and/or similar radio or light waves to provide location and time information from the beacon. The beacons signal the oncoming vessels when the vessels come into proximity with the hazards and/or other objects or individuals at a predetermined distance. Further, the beacons can be communicatively coupled to a server. The server receives data from the beacons. The data comprises location of the beacons and the beacon's registered owner. The data may be used to track and record the locations of the beacon when the beacons are changed from one buoy or hazard to another.

Figure 1A:
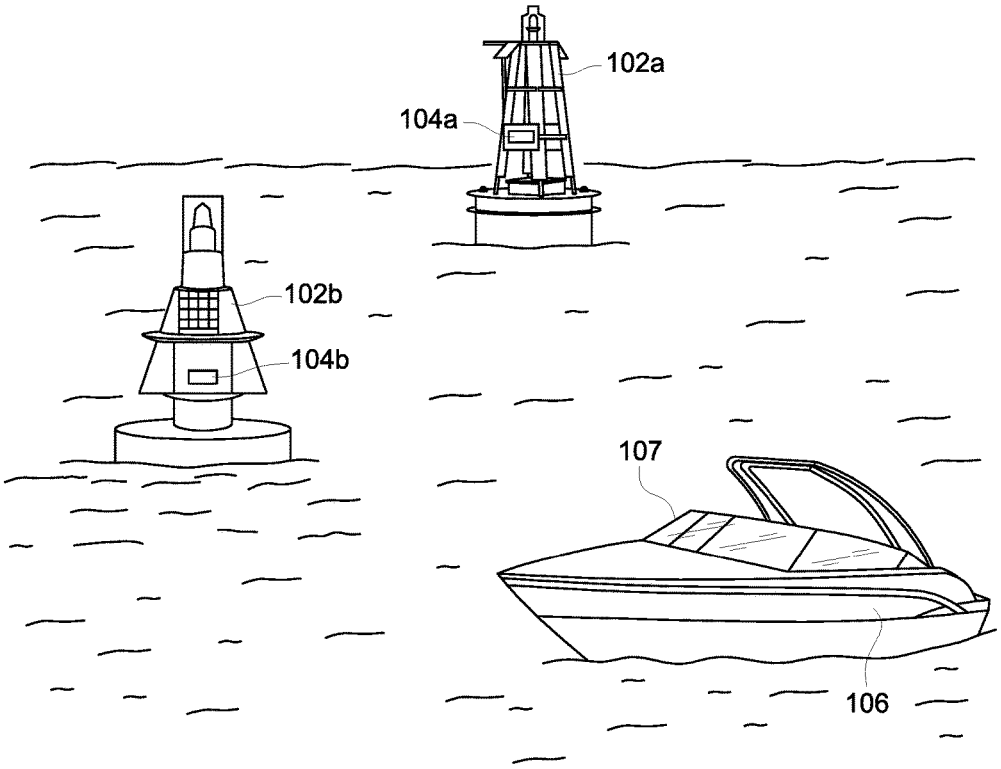
FIG. 1A illustrates beacons attached to various navigational hazards, in accordance with one embodiment of the present disclosure.
Figure 1B:
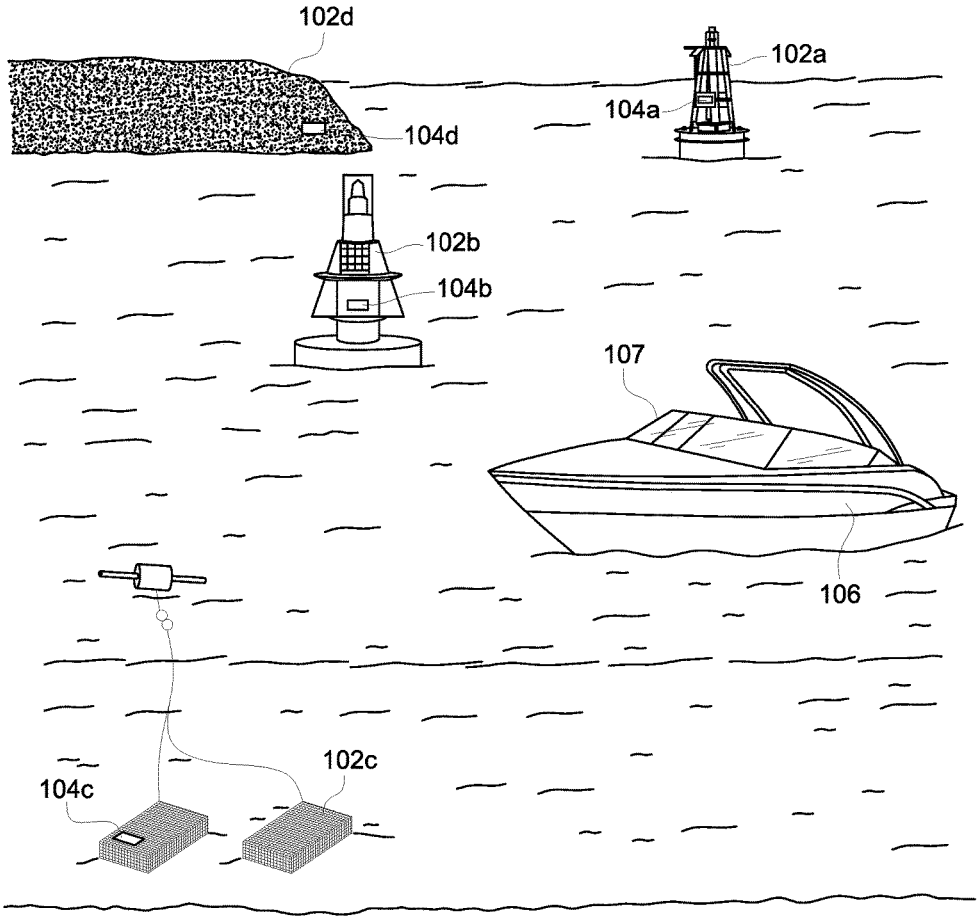
FIG. 1B illustrates beacons attached to various navigational hazards, in accordance with one embodiment of the present disclosure including lobster traps and jetties.
Figure 1C:
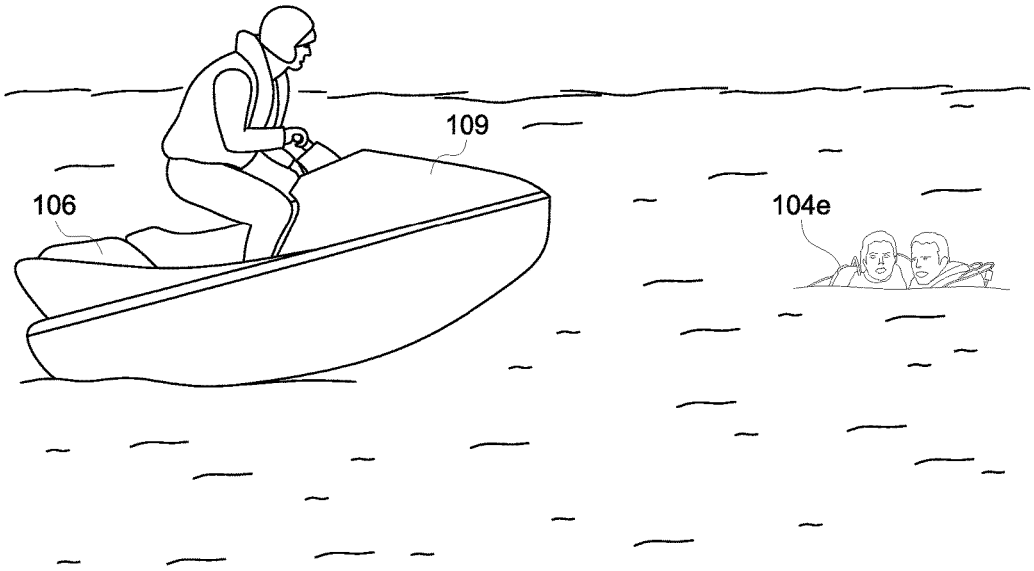
FIG. 1C shows a passenger having fallen overboard with a beacon attached to her life jacket emitting a signal being received by a vessel's captain or other personnel through the receiving device.
Figure 2:
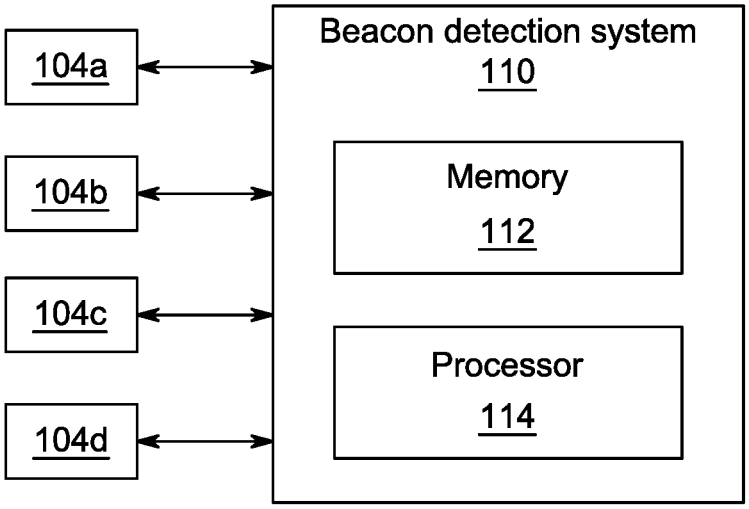
FIG. 2 illustrates a schematic showing the components within the beacon.
Figure 3:
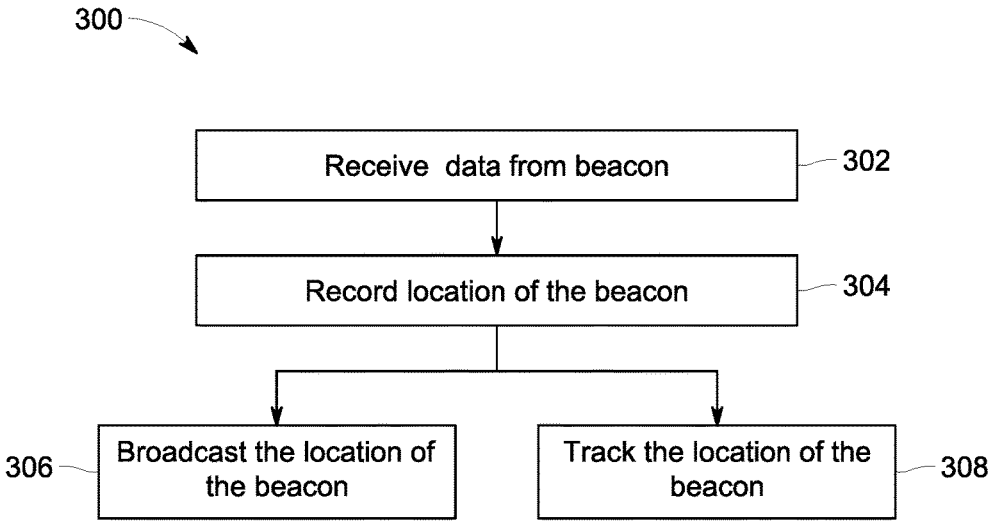
FIG. 3 shows a method for managing the beacons, in accordance with one embodiment of the present disclosure.

Various features and embodiments of the beacons attached to the buoys or lifejackets of users are explained in conjunction with the description of FIGS. 1-3.

Referring now to FIG. 1, a plurality of buoys (102*a*, 102*b*, 102*c*) present in the sea is shown, in accordance with one embodiment of the present disclosure. The plurality of buoys (102*a*, 102*b*, 102*c*) may be placed at shallow areas, hazard areas, where divers are present in the sea and so on. In another example, the buoys (102*a*, 102*b*) may be connected to crab and/or lobster traps (102*c*) that are positioned in the sea by fishermen or exposed shipwrecks or natural formations that pose a danger to navigating vessels (102*d*). The buoys (102*a*, 102*b*) placed in the sea may float above the water surface and serve as a reference point to indicate placement of the crab and/or lobster traps (102*c*) on the seabed. Those buoys create a navigational hazard. Although the present disclosure is explained considering that buoys are present in the sea, it should be understood that other structures such light house, poles, floating objects may be used in waters such as a river or lakes to indicate hazards, shallow areas, presence of divers, overboard passengers and so on and beacons (104*a*, 104*b*, 104*c*, and 104*d*) can be applied thereon.

Each of the plurality of buoys e.g., the buoy 102*a* comprises a beacon 104*a*. The beacon is a small device for example, 3 cm×5 cm×2 cm, or the size of a small coin, that constantly emits signals to a nearby interfacing device 107, containing a small amount of data including but not limited to the identity beacon's 104*a* owner. Strength of the signal and time between each signal transmitted by each beacon may be configured to give a desired coverage. In one example, the beacon may be configured to send the signal up to 100 meters. In another example, the beacon may be configured to send the signal up to 50 meters. It should be understood that the beacon might be configured to broadcast the signal up to a predetermined distance. As there is no obstruction in the sea such as wall, or any other structure, the signal may be sent up to the distance as may be configured. The data sent by the beacon may comprise location of the beacon and its registration information. The data sent by the beacon may be hard coded and is not changed frequently. The beacon 104*a*, 104*b*, 104*c* and 104*d* may be powered by a battery or by a solar powered cell. Beacon 104*a* can be configured to constantly or intermittently send out a Bluetooth, radio or other similar signal to nearby receiving hardware 107 and 109.

As shown in FIG. 1, the beacon 104*a* is attached to the buoy 102*a*. The beacon 104*a* may be attached to the buoy 102*a* by a suitable means as known in the art. Similarly, the beacon 104*b* is attached to the buoy 102*b*. Similarly, the beacon 104*c* is attached to crab or lobster trap 102*c*. Similarly, the beacon 104*d* is attached to the jetty 102*d*. The beacons 104*a*, 104*b*, 104*c* and 104*d* can be configured to continuously or intermittently send out Bluetooth signals. The signals sent by the beacons (104*a*, 104*b*, 104*c* and 104*d*) may be captured by a vessel 106, equipped with an interfacing receiving device 107, which is sailing towards the beacons (104*a*, 104*b*, 104*c* and 104*d*). Specifically, the interfacing receiving hardware 107 and will capture or receive the signals and upon receiving the signal will alert the user of the vessel of the upcoming potential hazard. Mariners may opt to equip their vessel with a plurality of sensors located around the perimeter off the vessel, which can improve signal reception from beacons (104*a*, 104*b*, 104*c* and 104*d*). Sensors receive and then communicate data to the interfacing device 107. The interfacing device 107 calculates the beacons' (104*a*, 104*b*, 104*c*, and 104*d*) proximity to the vessel 106 and displays on a screen the location of the beacons (104*a*, 104*b*, 104*c* and 104*d*) in relation to the vessel.

Receiving device hardware 107 does not need to pair with the beacon using the Bluetooth signal as this will unnecessarily require additional time that the user could have already been alerted of the hazard. Instead, the receiving device hardware 107 can alert the user the moment it simply comes within range of the beacon 104*a*, 104*b*, 104*c* and 104*d*, and detects the presence of the signal. This can be achieved with light or radio signals and/or near field communication as well. Additionally, receiving device 107 can be configured to be a downloaded application on a mobile device so that a user can use his or her smartphone to detect the signals emitted from the beacons 104*a*, 104*b*, 104*c* and 104*d*.

In one embodiment, each of the beacons (104*a*, 104*b*, 104*c* and 104*d*) may be equipped with Bluetooth and/or similar radio frequency or light wave capable of providing the location of the respective beacon. The content transmitted by the signal can be customized to include registration and/or license information for a given buoy or other relevant information. The content can also be at least partially encrypted, and in those instances, receiving device 107 can include decryption means to decode the encrypted content transmitted by the beacon.

In accordance with one implementation of the present disclosure, each of the beacons (104*a*, 104*b*, 104*c* and 104*d*) alert the vessel 106 via interfacing hardware 107 when the vessel 106 is at a predetermined distance from the beacons (104*a*, 104*b*, 104*c* and 104*d*). The system subject of the present invention can be coupled to the Auto-Pilot navigational features of a vessel to alter a vessel's route and/or speed upon the interfacing device hardware 107 receiving a beacon's signal.

In one embodiment, the plurality of beacons (104*a*, 104*b*, 104*c* and 104*d*) may be communicatively connected to a system 110 as shown in FIG. 2. In the current embodiment, the system 110 is considered to be implemented on a server, however, it may be understood that the system 110 may also be implemented in a variety of computing systems, such as a mainframe computer, a network server, cloud, and the like. The beacons (104*a*, 104*b*, 104*c* and 104*d*) are communicatively coupled to the system 110 through a network (not shown). In one implementation, the network may be a wireless network.

In one embodiment, the system 110 may include a memory 112 and at least one processor 114. The memory 112 may include any computer-readable medium known in the art including, for example, volatile memory, such as static random access memory (SRAM) and dynamic random access memory (DRAM), and/or non-volatile memory, such as read only memory (ROM), erasable programmable ROM, flash memories, hard disks, optical disks, and magnetic tapes. The at least one processor 114 may be implemented as one or more microprocessors, microcomputers, microcontrollers, digital signal processors, central processing units, state machines, logic circuitries, and/or any devices that manipulate signals based on operational instructions. Among other capabilities, the at least one processor 114 is configured to fetch and execute computer-readable instructions or program instructions stored in the memory 112.

As an additional feature, the beacon 104*a* may share the data such as name of a person or fisherman who installed the beacon 104*a* at the buoy 102*a*. This information can be encoded in the beacon 104*a* so that a passerby or the authorities can identify the owner of that buoy and beacon. This data corresponding to the person who installed the beacon at the buoy may be used to associate any violations that take place at the buoy for law enforcement purposes.

In one embodiment, interfacing device 107 can determine whether the vessel 106 avoided the hazard (102*a*, 102*b*) or continued on to collide with the hazard (102*a*, 102*b*) and communicate that data to the system 110. The system 110 may analyze the data to derive analytics. For example, in addition to contact information, the beacon can also provide a summation for the number of vessels that crossed the beacons in a given time or distance at which each vessel that has passed the beacon, and which, if any, of those vessels may have come into contact with the buoy, causing it to become detached from the crab or lobster trap 102*c*.

Referring to FIG. 3, a method 300 for managing beacons by the system 110 is disclosed, in accordance with one embodiment of the present disclosure.

At step 302, the system 110 receives the data from the beacons (104*a*, 104*b*) using Bluetooth, Near-Field Communication, radio signals, and the like.

At step 304, the system 110 can record the location of the beacons from the data received from the beacons by using GPS in one instance.

At step 306, the system 110 may broadcast the location of the beacons to vessels that are in vicinity of the beacons.

At step 308, the system 110 may track the location of beacon to determine position of the beacon from time to time.

It is preferable to use beacons instead of cameras or sound signals as proposed in prior art, as the beacons of the present invention are inexpensive, discrete and accurate. Further, the beacons transmit a strong signal that the oncoming vessels can capture without any difficulty. As a result, the signal strength of the beacons is not as affected even during extreme weather conditions. Furthermore, the beacons may be affixed to the buoys that are present in the sea far away from shore and aid the vessels to navigate past the buoys and other hazards.

In addition, the data that the beacons can share may be used to update the oncoming vessels of presence of additional buoys and/or other hazards s in the vicinity.

The concept of the present invention can be understood as a "reverse" radar. The beacons will emit a sound/radio or light wave (Bluetooth or otherwise) which will be received by the receiving apparatus attached to the vessel. In a traditional radar setup, there is a mechanism affixed to a vessel which emits a radio wave. That radio wave travels until it reaches an object and then bounces back. The receiver on the vessel then interprets the return wave which has bounced off the object using an equation and displays on a screen what it is that is out there and even determines or calculates the distance from the object. The advantage of radar is that it can detect objects which are unknown and versatile (clouds, birds, land, airplanes, other boats, etc.).

The present invention differs from traditional radar in the sense that its objective is to identify only known and stationary objects and hazards (buoys, jettys, reefs, divers in the water) (102*a*, 102*b* and 102*d*) which are affixed with a beacon (104*a*, 104*b* and 104*d*). There is no mechanism on the vessel which emits a sound/radio or light wave (Bluetooth or otherwise). There is only a receiver 107 because the object, through its beacon, is effectively sending out a sound/radio or light wave (Bluetooth or otherwise). That wave is received by the receiver 107 on the vessel and interpreted on a display (like a RADAR screen) which outlines it determined distance or proximity to the receiver on the vessel and/or the vessel itself. With a traditional radar, proximity is measured by calculating the amount of time the radio wave takes to travel to the object from the vessel, bounce off of it, and return to the receiver on the vessel. The present invention cannot measure how long it takes for the light or sound/radio wave to travel before it gets to the receiver on the vessel because the wave is emitting independently from the beacon. Therefore, we are faced with a more complex product but one necessary to solve the unaddressed problem.

By emitting a sound/radio or light wave (Bluetooth or otherwise) intermittently from the beacon (104*a*, 104*b* and 104*d*), the signal being broken up by a break of equal predetermined amount of time (i.e. a second, half a second, or milliseconds), the receiver 107 can measure the changes in the time between breaks (to the millisecond) and determine the proximity at the various intervals and then display it on a screen, like the radar does. Since the amount of time the wave takes to travel from the beacon to the vessel will be less as the beacon gets closer, the receiver 107 can determine the distance, as a radar does, by measuring the difference in the amount of time between each break in the wave (measured running time). A plurality of sensors around the circumference of the vessel 106 can triangulate the signal from beacons (104*a*, 104*b* and 104*d*) and determine the precise location of the each beacon from the various points within or about the vessel 106. The present invention is also different from the prior art because it uses a sound/radio or light wave (Bluetooth or otherwise), so the waves that are being used to measure proximity may be accompanied by a signal or also carry information related to the beacon itself including the owner name, the type of hazard or object, etc.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A marine hazard avoidance device, comprising: a vessel, a plurality of beacons each attached to various marine and other hazards, each of said plurality of beacons continuously and independently emitting an unmodulated electromagnetic frequency signal, wherein said plurality of beacons emit said electromagnetic frequency signal without requiring a trigger signal from a surrounding device, a plurality of receiving devices mounted along the circumference of the vessel, said plurality of receiving devices receive said electromagnetic frequency signal, a display unit displays the location, proximity, or direction of the marine hazards using said electromagnetic frequency signal.

2. The marine hazard avoidance device of claim 1 wherein said display unit displays the proximity of each marine hazard to said vessel.

3. The marine hazard avoidance device of claim 1 wherein said vessel includes a navigation system, said display unit is implemented into the navigation system.

4. The marine hazard avoidance device of claim 1 wherein said hazards are color-coded on said display unit.

5. The marine hazard avoidance device of claim 1 wherein said plurality of receiving devices provide an alert upon said marine hazards being closer than a predetermined distance, said alert is triggered using electromagnetic frequency signal without having to wait for the plurality of beacons to pair with the receiving devices.

6. The marine hazard avoidance device of claim 1 wherein said beacon's electromagnetic frequency signal includes information relating to the owner of the marine hazard or information relating to the hazard itself.

7. The marine hazard avoidance device of claim 1 wherein said electromagnetic frequency signal is intermittent.

8. The marine hazard avoidance device of claim 1 wherein said electromagnetic frequency signal is selectively turned on and off.

9. The marine hazard avoidance device of claim 1 wherein said electromagnetic frequency signal is remotely turned on and off.

10. The marine hazard avoidance device of claim 1 wherein said plurality of beacons include a solar powered battery.

11. The marine hazard avoidance device of claim 1 wherein said plurality of receiving devices are mounted at the vessel's hull at its bow, stern, port, starboard, or any combination thereof.

12. The marine hazard avoidance device of claim 1 wherein said electromagnetic frequency is Bluetooth or Near Field Communication.

13. The marine hazard avoidance device of claim 1 wherein said display unit displays the location, proximity, or direction of the marine hazards in real-time.

* * * * *